US008371763B2

(12) United States Patent
Kim et al.

(10) Patent No.: US 8,371,763 B2
(45) Date of Patent: Feb. 12, 2013

(54) MOBILE IMAGE FORMING APPARATUS

(75) Inventors: Sin-ae Kim, Suwon-si (KR); Yong-duk Lee, Gunpo-si (KR); Ho-gun You, Hwaseong-si (KR); Dong-hun Han, Suwon-si (KR)

(73) Assignee: Samsung Electronics Co., Ltd, Suwon-si, Gyeonggi-do ( * ) Notice: Subject to any disclaimer, the term of this patent is extended or adjusted under 35 U.S.C. 154(b) by 1038 days.

(21) Appl. No.: 11/945,487

(22) Filed: Nov. 27, 2007

(65) Prior Publication Data

US 2008/0317496 A1 Dec. 25, 2008

(30) Foreign Application Priority Data

Jun. 22, 2007 (KR) ..... 10-2007-0061533

(51) Int. Cl.

| | |
|---|---|
| ***B41J 3/36*** | (2006.01) |
| ***B41J 11/70*** | (2006.01) |
| ***B41J 15/00*** | (2006.01) |
| ***B41J 29/02*** | (2006.01) |
| ***B41J 29/13*** | (2006.01) |

(52) U.S. Cl. ..... 400/88; 400/693; 347/222

(58) Field of Classification Search ..... 400/88, 400/693; 347/222, 109

See application file for complete search history.

(56) References Cited

U.S. PATENT DOCUMENTS

| | | | | |
|---|---|---|---|---|
| 6,276,850 | B1 * | 8/2001 | Silverbrook et al. | 400/615.2 |
| 6,848,850 | B2 * | 2/2005 | Matsuo et al. | 400/693 |
| 7,341,219 | B2 * | 3/2008 | Myers et al. | 242/596.7 |
| 7,733,361 | B2 * | 6/2010 | Choi et al. | 347/171 |
| 2002/0141806 | A1 * | 10/2002 | Endo et al. | 400/693 |
| 2005/0162497 | A1 * | 7/2005 | Matsui et al. | 347/109 |
| 2005/0286958 | A1 * | 12/2005 | Shiratori | 400/642 |

FOREIGN PATENT DOCUMENTS

| | | | |
|---|---|---|---|
| JP | 06312557 | A * | 11/1994 |
| JP | 08300758 | A * | 11/1996 |
| JP | 09156142 | A * | 6/1997 |
| JP | 2001080130 | A * | 3/2001 |
| JP | 2001130057 | A * | 5/2001 |
| JP | 2001232862 | A * | 8/2001 |
| JP | 2002011908 | A * | 1/2002 |
| JP | 2004216732 | A * | 8/2004 |
| JP | 2007062283 | A * | 3/2007 |
| WO | WO 2006123865 | A1 * | 11/2006 |

* cited by examiner

*Primary Examiner* — Daniel J Colilla

(74) *Attorney, Agent, or Firm* — Stanzione & Kim, LLP

(57) ABSTRACT

A mobile image forming apparatus is provided that comprises a casing, a support frame to surround a printing medium roll from which a printing medium is supplied and to guide the printing medium, an image forming unit to form an image on the printing medium guided by the support frame and a printing medium receiving portion disposed between the casing and the support frame to receive therein the printing medium on which the image is formed by the image forming unit. The mobile image forming apparatus may further comprise a roll support core disposed in the support frame to rotatably support the printing medium roll.

22 Claims, 14 Drawing Sheets

MOBILE IMAGE FORMING APPARATUS

CROSS-REFERENCE TO RELATED APPLICATIONS

This application claims priority under 35 U.S.C. §119(a) from Korean Patent Application No. 10-2007-0061533, filed on Jun. 22, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to a mobile image forming apparatus which is improved in portability.

2. Description of the Related Art

In general, an image forming apparatus is connected to a host device in which image data is stored and visualizes the image data on a printing medium according to an output signal of the host device. Such an image forming apparatus may be classified into an ink jet type, an electrophotographic type, a dye sublimation type, etc. according to a method and function for image forming.

Recently, the image forming apparatus may be connected to a portable host device to communicate image data. Particularly, as a photography technology for image data has been under rapid development, many users can directly print photographic image data which are photographed by the users through the image forming apparatus.

Coping with this trend, an image forming apparatus for printing the photographic image data only has been developed. Particularly, an image forming apparatus of a dye sublimation type is widely used for photographic image data printing in consideration of its superior resistance to image deterioration due to physical characteristics such as moisture, good image preservation and high resolution.

However, the image forming apparatus for the photographic image data printing is conventionally too large in size for a user to carry this device, and thus, it is not practical for the user to carry such a device from one location to another and directly print the image data through the image forming apparatus.

Further, because the conventional image forming apparatus has no printing medium storage unit to store therein printing mediums, a user has to manually supply a printing medium to print, and thus, it is difficult to continuously print a plurality of image data.

Furthermore, in the conventional image forming apparatus, a printing medium having an image formed thereon is exposed to the outside of the apparatus while being transported by a user. Accordingly, the user has to directly touch the printing medium, thereby contaminating a surface of the printing medium.

SUMMARY OF THE INVENTION

The present general inventive concept provides an image forming apparatus which is conveniently portable and can prevent exposure of an image formed printing medium.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing a mobile image forming apparatus comprising a casing, a support frame to surround a printing medium roll from which a printing medium is supplied and to guide the printing medium, an image forming unit to form an image on the printing medium guided by the support frame and a printing medium receiving portion disposed between the casing and the support frame to receive therein the printing medium on which the image is formed by the image forming unit.

The mobile image forming apparatus may further comprise a roll support core disposed in the support frame to rotatably support the printing medium roll.

Here, the roll support core may be eccentrically disposed in a central area of the casing.

The mobile image forming apparatus may further comprise a cutting portion disposed between the roll support core and the image forming unit to cut the printing medium supplied from the printing medium roll into a predetermined length.

The casing may be formed with a side opening through which at least a portion of the printing medium receiving portion is exposed outside.

The mobile image forming apparatus may further comprise a door coupled to the casing to open and close the side opening.

The casing may have a cylindrical shape of a circular or polygonal section.

The casing may comprise a main casing to accommodate the image forming unit and the support frame, and a cover to open and close a top opening of the main casing.

The printing medium receiving portion may comprise a printing medium support rib to protrude from an inner surface of the casing and to support a trailing edge portion of the printing medium on which the image is formed. The printing medium receiving portion may receive therein the plurality of printing mediums.

The image forming unit may comprise a heat sensitive print head to heat the printing medium, and a platen to support the printing medium against the heat sensitive print head. The image forming unit may further comprise a ribbon supplying core disposed at a first side of the heat sensitive print head to supply an ink ribbon, and a ribbon collecting core disposed at a second side of the heat sensitive print head to collect the ink ribbon.

The mobile image forming apparatus may further comprise a transfer roller to transfer the printing medium to the image forming unit and a discharge roller to discharge the printing medium on which the image is formed to the printing medium receiving portion.

The transfer roller and the discharge roller may be rotatable in a forward direction and a backward direction.

The transfer roller, the discharge roller and the image forming unit may be arranged in an arc shape around the roll support core.

The support frame may be formed with a backward transfer guide to guide the printing medium transferred in the backward direction by a backward rotation of the transfer roller and the discharge roller.

The backward transfer guide may be extended from the printing medium receiving portion.

The mobile image forming apparatus may further comprise a direction change lever disposed at a side of the transfer roller to guide the printing medium to the backward transfer guide when the printing medium is transferred in the backward direction.

The foregoing and/or other aspects and utilities of the general inventive concept may also be achieved by providing an image forming apparatus comprising a casing having a covering member movable between an open state and a closed state, and a support frame disposed within the casing to form a print medium receiving area to receive a print medium supply and a print medium guiding area to guide a portion of the print medium supply, wherein the cover member provides access to the print medium receiving area through an opening in the open state and prevents access to the print medium receiving area through the opening in the closed state.

The foregoing and/or other aspects and utilities of the general inventive concept may also be achieved by providing an image forming apparatus including an image forming unit to form an image on a printing medium, the image forming apparatus comprising a casing including a cover to provide access to a print medium storage and receiving area, a first region inside the casing to store a print medium and supply the print medium to the image forming unit; and a second region to receive the printing medium after passing through the image forming unit.

The foregoing and/or other aspects and utilities of the general inventive concept may also be achieved by providing a method of loading a print medium supply into an image forming apparatus, the method comprising moving a covering member of a casing to an open state to provide access to a print medium receiving area, placing the print medium supply to the print medium receiving area formed by a support frame, positioning a portion of the print medium supply to a print medium guiding area formed between the casing and the support frame to guide a portion of the print medium supply and moving the covering member to a closed state to prevent access to the print medium supply.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1A:
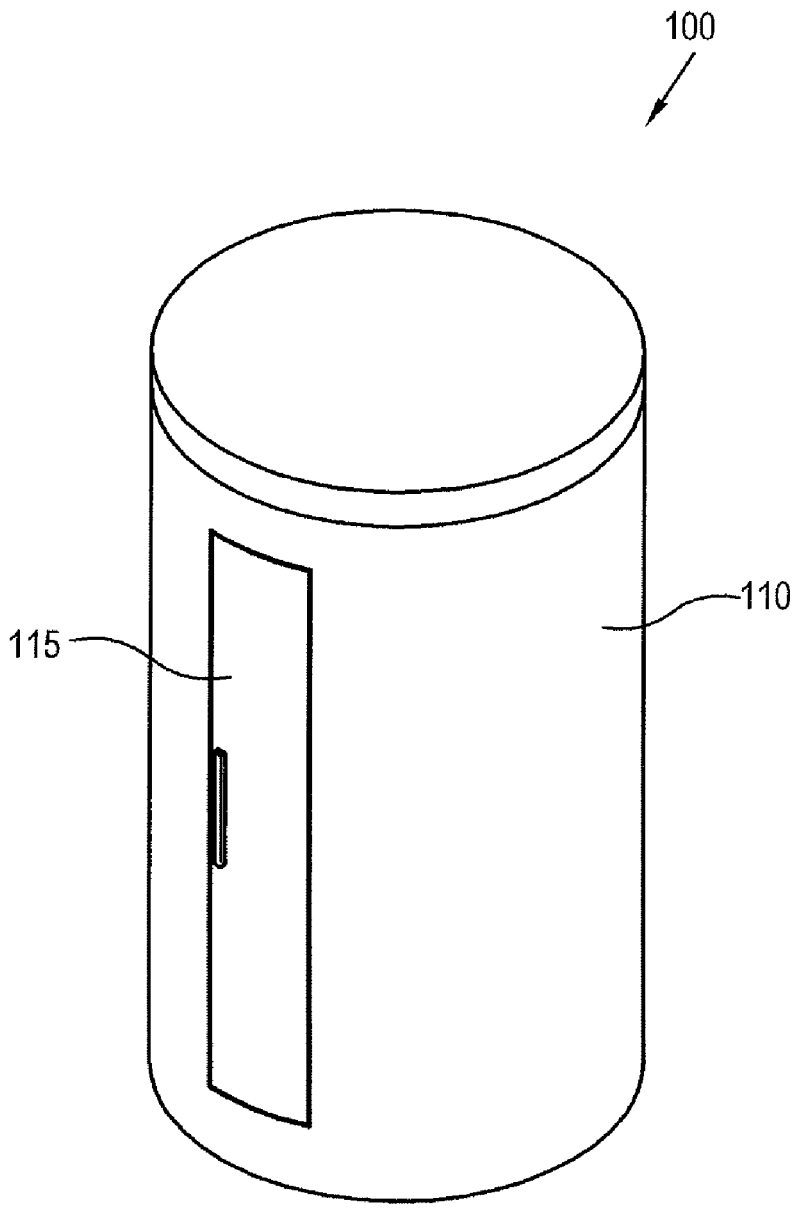
FIGS. 1A and 1B are perspective views illustrating an outside appearance of an image forming apparatus according to an exemplary embodiment of the present general inventive concept.

Reference will now be made in detail to embodiments of the present general inventive concept, examples of which are illustrated in the accompanying drawings, wherein like reference numerals refer to like elements throughout. The exemplary embodiments are described below so as to explain the present general inventive concept by referring to the figures.

Referring to FIG. 1A to FIG. 3, an image forming apparatus 100 according to an exemplary embodiment of the present general inventive concept includes a casing 110, an image forming unit 150 to form an image on a printing medium M, a support frame 120 which is provided inside the casing 110 to guide the printing medium M which is supplied from a printing medium roll MR towards the image forming unit 150, and a printing medium receiving portion 160 in which the image formed printing medium M is received.

Further, the image forming apparatus 100 includes a roll support core 130 disposed in the support frame 120 and supports the printing medium roll MR, a plurality of printing medium transferring members 141, 143, 145 and 147, to transfer the printing medium M to and out of the image forming unit 150 and the printing medium receiving portion 160, and a cutting portion 170 to cut the printing medium M into a predetermined length.

The casing 110 has such a structure to prevent the printing medium M from being exposed to the outside. The casing 110, for example, can have a cylindrical shape. A height of the casing 110 can be determined in consideration of a width of the printing medium M and a volume of a driving unit (not illustrated).

The casing 110 includes a main casing 111 to accommodate the support frame 120 and the image forming unit 150, and a cover 117 to cover a top opening of the main casing 111.

The main casing 111 includes a side opening 113 through which the image formed printing medium M is discharged, and a door 115 to open and cover the side opening 113. The side opening 113 has a size such that at least a portion of the printing medium receiving portion 160 is exposed to the outside. Thus, a user can open the door 115 and draw out a leading edge portion a (FIG. 5A) of the image formed printing medium M to discharge it (refer to FIG. 5E). Here, a height h1 of the door 115 may be larger than the width of the printing medium M.

Figure 2A:
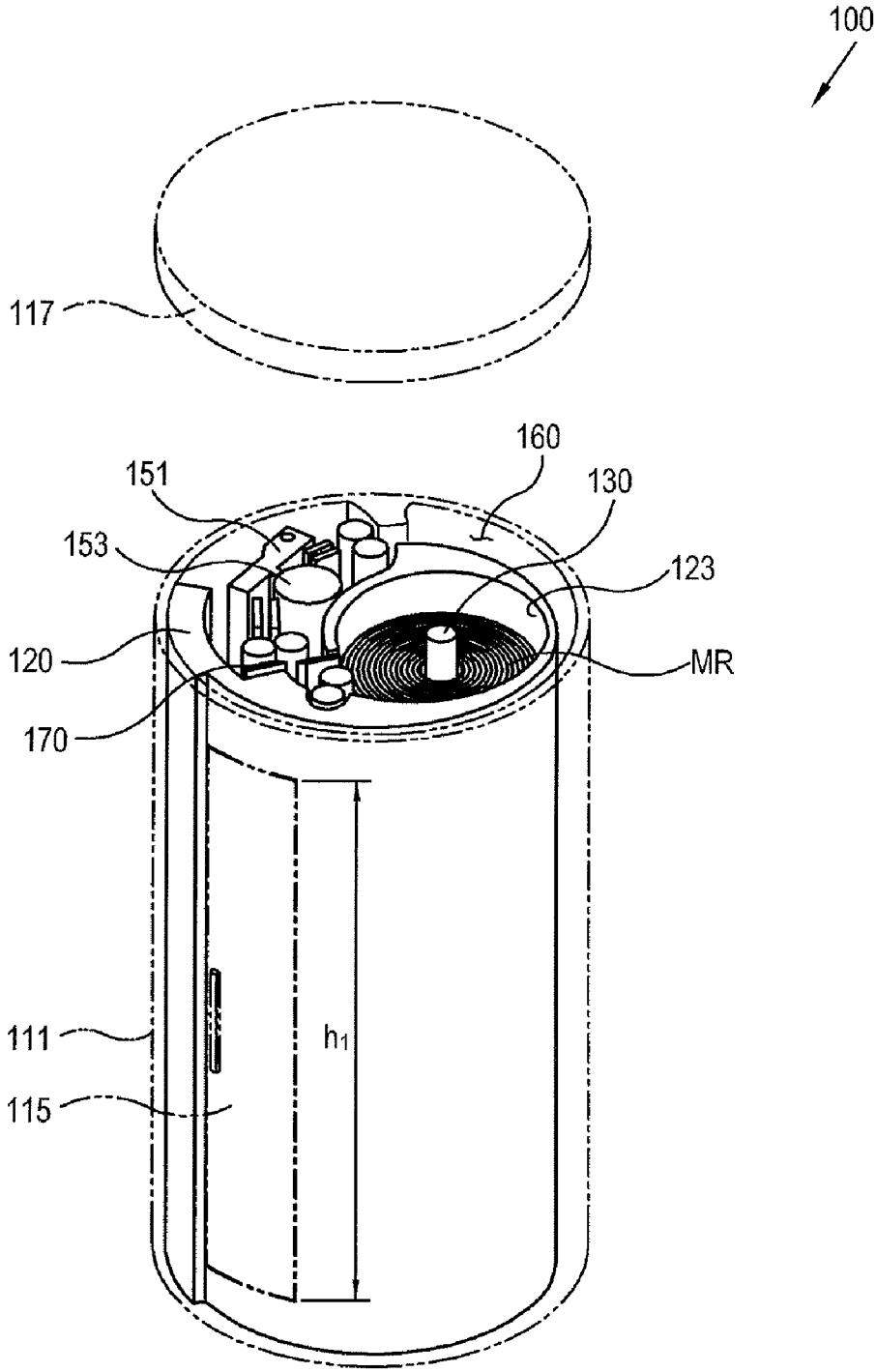
FIG. 2A is a perspective view illustrating the image forming apparatus according to the exemplary embodiment of FIGS. 1A and 1B.
Figure 2B:
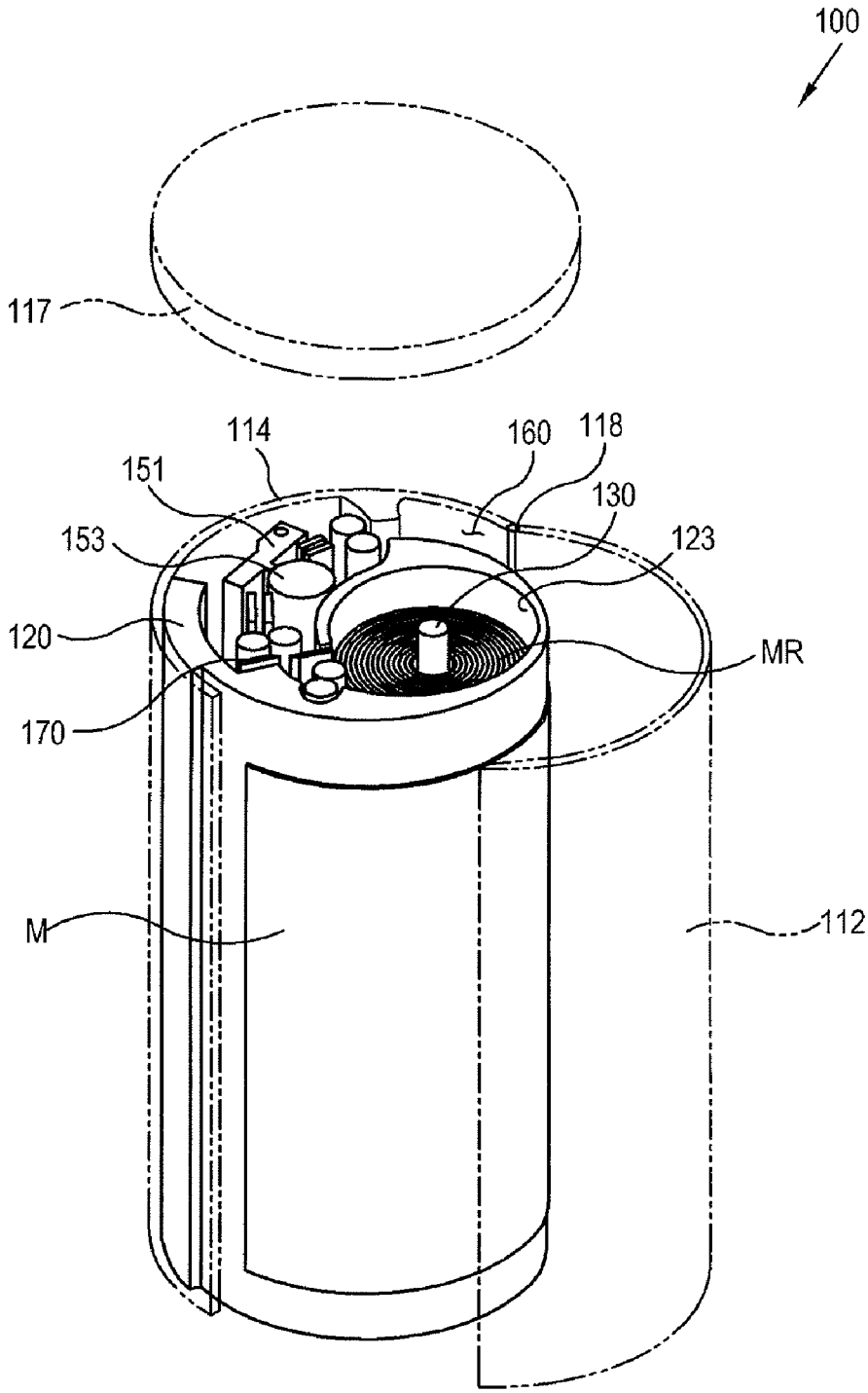
FIG. 2B is a perspective view illustrating an image forming apparatus according to another exemplary embodiment of the present general inventive concept.

Alternatively, as illustrated in FIG. 2B, the side opening 113 and the door 115 may be replaced with a first casing portion 114 which is rotatably coupled with a second casing portion 112. The first casing portion 114 can rotate around a hinge portion 118 and form a discharge opening at a side of the main casing 111 opposite to the hinge portion 118. Accordingly, the entire portion of the printing medium receiving portion 160 may be exposed outside. Thus, a plurality of printing mediums can be received in and discharged from the printing medium receiving portion 160.

The cover 117 may be separated from a top of the main casing 111, as illustrated in FIG. 2A. Alternatively, the cover 117 may be coupled with the top of the main casing 111 at a portion thereof to open and close the top opening of the main casing 111. The cover 117 opens the top opening of the main casing 111 to exchange the printing medium roll MR, or to fix problems which may occur in the main casing 111. The cover may be opened to discharge the image formed printing medium M through the top opening of the main casing 111 instead of the side opening 113.

Figure 3:
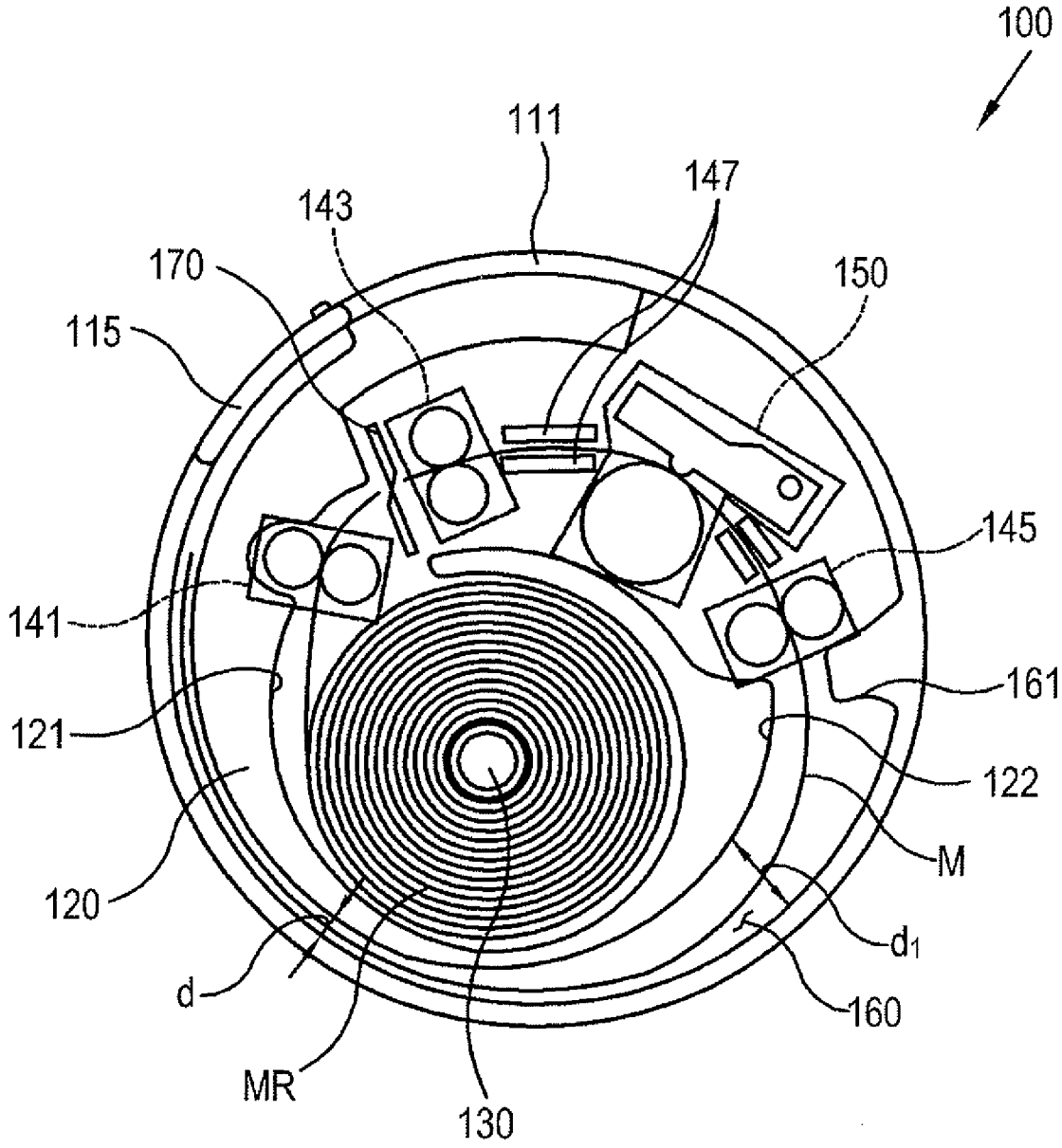
FIG. 3 illustrates a section of the image forming apparatus according to the exemplary embodiment of FIGS. 1A and 1B.

The support frame 120 forms a space to accommodate the printing medium roll MR inside the casing 110, as illustrated in FIG. 3, and to guide the printing medium M supplied from the printing medium roll MR toward the image forming unit 150. The support frame 120 can have a cross section of a spiral shape to surround the printing medium roll MR. The support frame 120 includes an accommodating portion 122 to accommodate the printing medium roll MR, and a guide portion 121 to guide the printing medium M.

The accommodating portion 122 is provided to surround the printing medium roll MR. The gap between the printing medium roll MR and the accommodating portion 122 can be determined in consideration of a maximum volume of the printing medium roll MR.

The guide portion 121 extends as a curved surface from the accommodating portion 122 to guide the printing medium M supplied from the printing medium roll MR along a spiral path. The printing medium M generally tends to travel straight. Accordingly, the guide portion 121 guides the printing medium M while contacting the printing medium M until the leading edge portion a (FIG. 5A) of the printing medium M reaches a pickup roller 141 (to be described later).

The support frame 120 is spaced from the casing 110 by a predetermined distance d, to form the printing medium receiving portion 160 in which the image formed printing medium is received.

The roll support core 130 is eccentrically disposed in a central area of the casing 110 to support the printing medium roll MR to supply the printing medium M toward the image forming unit 150 while being rotated by the driving unit (not illustrated).

The image forming unit 150 forms an image on the printing medium M supplied from the printing medium roll MR. According to the present embodiment, the image forming unit 150 may form an image by a heat sensitive method.

The image forming unit 150 of the heat sensitive type generally includes a heat sensitive print head 151 (FIGS. 2A and 2B) to heat the printing medium M, and a platen 153 to support the printing medium M to the heat sensitive print head 151.

Figure 4:
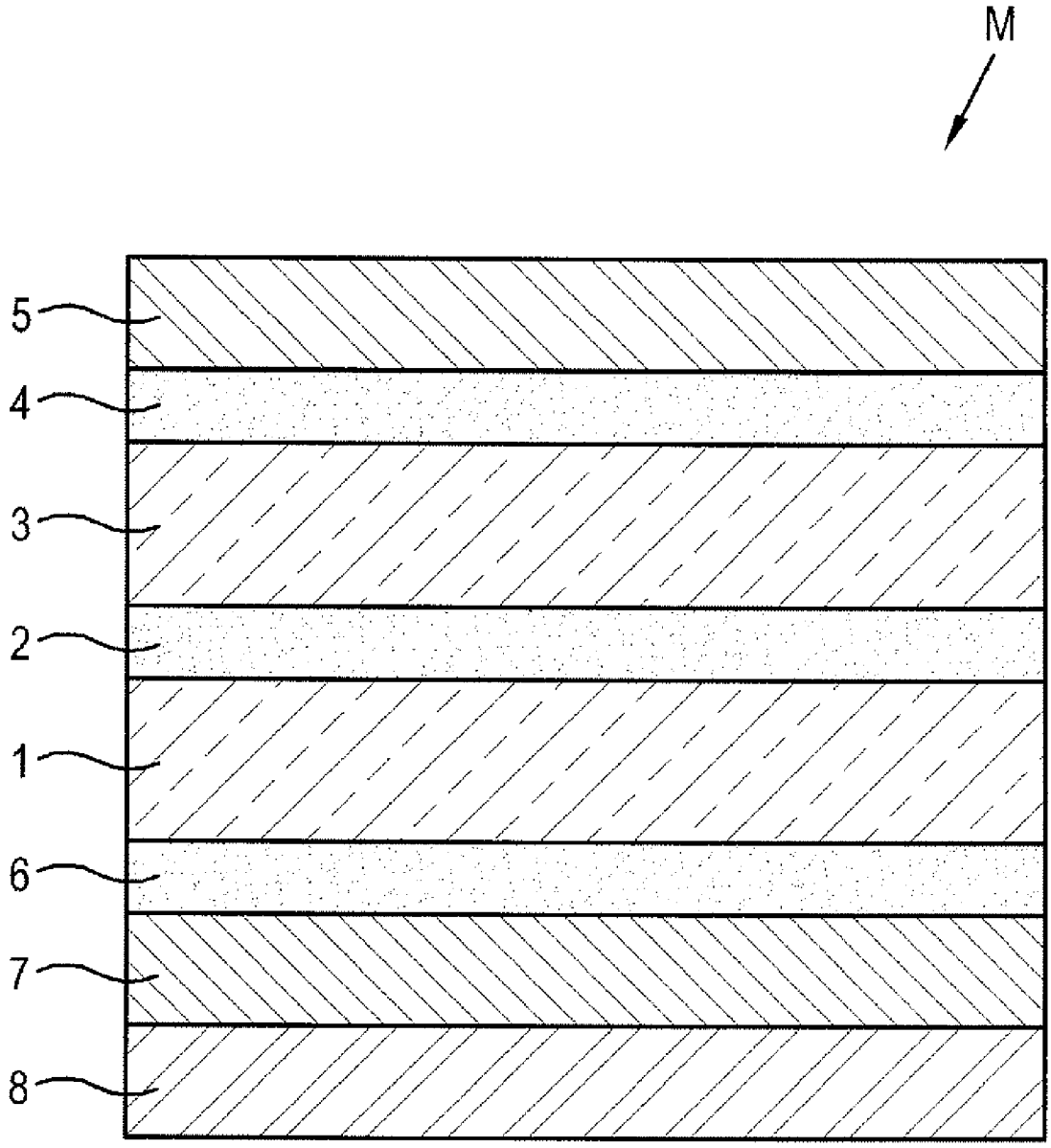
FIG. 4 illustrates a section of a printing medium to be used with the image forming apparatus according to the exemplary embodiments of the present general inventive concept.

The printing medium M may have a color selected according to a heating temperature and a time period at which heat is applied by the heat sensitive print head 151 to provide a color image, and thus, may be different from a typical printing paper. For example, as illustrated in FIG. 4, the printing medium M may include a transparent substrate 1; a first image forming layer 2, a spacer 3, a second image forming layer 4 and an upper cover layer 5, which are sequentially layered on an upper side of the substrate 1; and a third image forming layer 6, a reflecting layer 7 and a lower cover layer 8, which are sequentially arranged on a lower side of the substrate 1.

The first to third image forming layers 2, 4 and 6 may include leuco dyes having colors of yellow (Y), magenta (M) and cyan (C), and developer, respectively, to provide different colors. The first to third image forming layers 2, 4 and 6 may present different colors by different heating temperatures and time periods to apply heat.

The spacer 3 is interposed between the first image forming layer 2 and the second image forming layer 4, and may include a transparent material to allow colors of the first and third image forming layers 2 and 6 to be viewed through the upper cover layer 5.

In an exemplary embodiment, the printing medium M may be the printing medium roll MR supported by the roll support core 130.

Referring to FIGS. 2A and 4, the heat sensitive print head 151 includes a plurality of heating elements each having a very small size and arranged at a predetermined interval to correspond to the width of the printing medium M. A number of the heating elements may be suitably determined according to desired resolution. The respective heating elements may be controlled to individually generate heat to form an image. Further, the respective heating elements may be controlled to generate heat at different temperatures considering that the respective image forming ink layers 2, 4 and 6 are heat-sensitive at different temperatures to form images.

Referring to FIG. 2A, the heat sensitive print head 151 is spaced from the platen 153 before the printing medium M is supplied thereto, and approaches the platen 153 when the printing medium M is supplied thereto to apply heat and pressure to the printing medium M.

The heat sensitive print head 151 may be provided in a plurality as necessary. Configurations of the heat sensitive print head 151 are known in the art, and accordingly, a further detailed description thereof will be omitted.

Referring to FIG. 3, the printing medium transferring members 141, 143, 145 and 147 transfer the printing medium M guided by the guide portion 121 to the image forming unit 150 and transfer the printing medium M on which an image is formed by the image forming unit 150 to the printing medium receiving portion 160. More particularly, the printing medium transferring members include the pickup roller 141 which is disposed near the printing medium roll MR to pick up the leading edge portion a of the printing medium M guided by the guide portion 121, a transfer roller 143 to transfer the printing medium M passed through the pickup roller 141 to the image forming unit 150, and a discharge roller 145 to transfer the image formed printing medium M to the printing medium receiving portion 160. The printing medium transferring members may further include at least a guide member 147 which is disposed between the transfer roller 143 and the image forming unit 150 or between the image forming unit 150 and the printing medium receiving portion 160 to guide the transfer of the printing medium M.

Here, the pickup roller 141, the transfer roller 143, the discharge roller 145 and the guide member 147 are disposed around the printing medium roll MR, together with the image forming unit 150. Accordingly, a transfer path of the printing medium M generally forms a spiral arc around the printing medium roll MR. The guide member 147 guides the printing medium M to travel along the spiral path.

The printing medium receiving portion 160 receives therein the printing medium M on which an image is formed through the image forming unit 150. The printing medium receiving portion 160 is provided as a space formed between the casing 110 and the support frame 120.

An amount of the printing medium M which is received in the printing medium receiving portion 160 is determined depending on a distance d between an inner surface of the casing 110 and the support frame 120. The distance d affects the entire volume of the casing 110, and thus, is determined so that a user can conveniently carry the image forming apparatus.

The length of the printing medium receiving portion 160 may be determined corresponding to a length of the printing medium M. If the length of the printing medium receiving portion 160 is longer than that of the printing medium M, the printing medium M may move or float out of its position and contact the inner surface of the casing 110, thereby contaminating the image formed on the printing medium M. Accordingly, the printing medium receiving portion 160 has a length configured to prevent the printing medium M from moving or floating out of its position.

The printing medium receiving portion 160 may include a printing medium support rib 161 to protrude from the inner surface of the casing 110 at an exiting side of the discharge roller 145 and to support a trailing edge portion b of the printing medium M (see FIGS. 3 and 5D) to prevent the printing medium M from moving or floating out of its position. The printing medium support rib 161 may have a curved portion to prevent the printing medium M from moving back toward the discharge roller 145.

In the case that the printing medium M is supplied from the printing medium roll MR like the present embodiment, the cutting portion 170 may be provided between the pickup roller 141 and the transfer roller 143 to cut the printing medium M. The cutting portion 170 may cut the printing medium M into a fixed length or a variable length according to a size of the image data, which is controlled by a control signal of the control unit (not illustrated). The cutting portion 170 may include a pair of cutters which reciprocally move to cut the printing medium M.

Alternatively, the cutting portion 170 may not be required, for example, where the printing medium M supplied from the printing medium roll MR has a cutting line thereon to allow a user to cut the printing medium M manually, or where the printing medium M is supplied from a printing medium storing unit (not illustrated) in which a plurality of printing mediums are stored instead of the printing medium roll MR.

Although not illustrated, at a lower portion of the casing 110 the driving unit to drive the printing medium transferring members 141, 143 and 145 and the image forming unit 150 may be disposed, and the control unit to control the above elements. Further, at the lower portion of the casing 110 a memory portion in which image data is stored may be disposed.

An image forming process of the above-configured image forming apparatus according to the present embodiment will be described with reference to FIGS. 2A and 5A to 5E.

Firstly, as illustrated in FIG. 2A, the cover 117 is opened and the printing medium roll MR is mounted on the roll support core 130. Then, the cover 117 is closed. In this state, if a printing signal is input, the roll support core 130 and the printing roll MR rotate, and thus, the printing medium M moves towards the pickup roller 141.

Figure 5A:
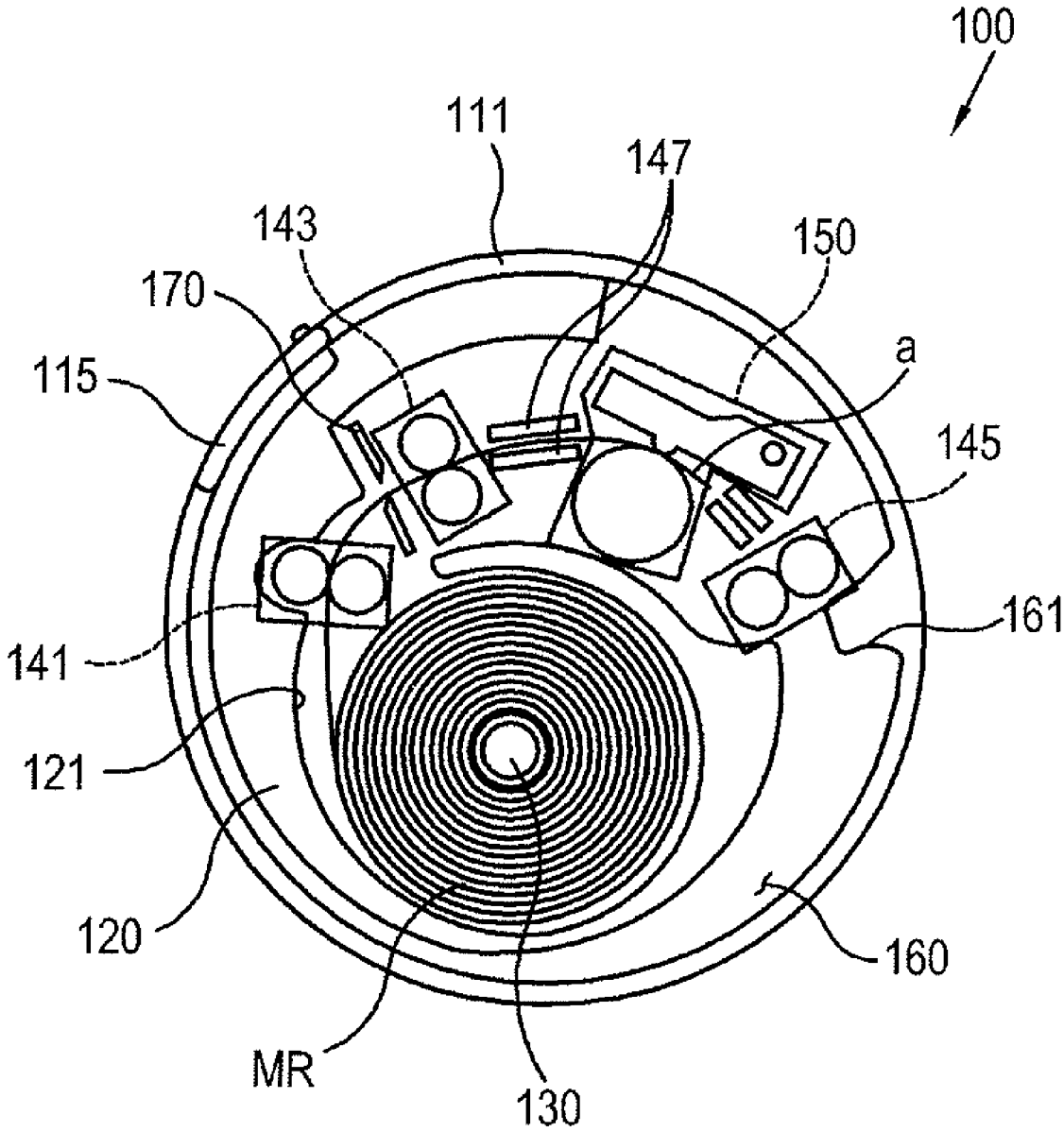
FIGS. 5A to 5E illustrate an operation process of the image forming apparatus according to the exemplary embodiments of the present general inventive concept.

Then, as illustrated in FIG. 5A, the leading edge portion a of the printing medium M moves along the guide portion 121, passes through the pickup roller 141 and the transfer roller 143, and is guided to the image forming unit 150.

The heat sensitive print head 151 of the image forming unit 150 applies heat to the printing medium M, and thus, the ink layers of different colors are activated by the heat to form a color image.

Figure 5B:
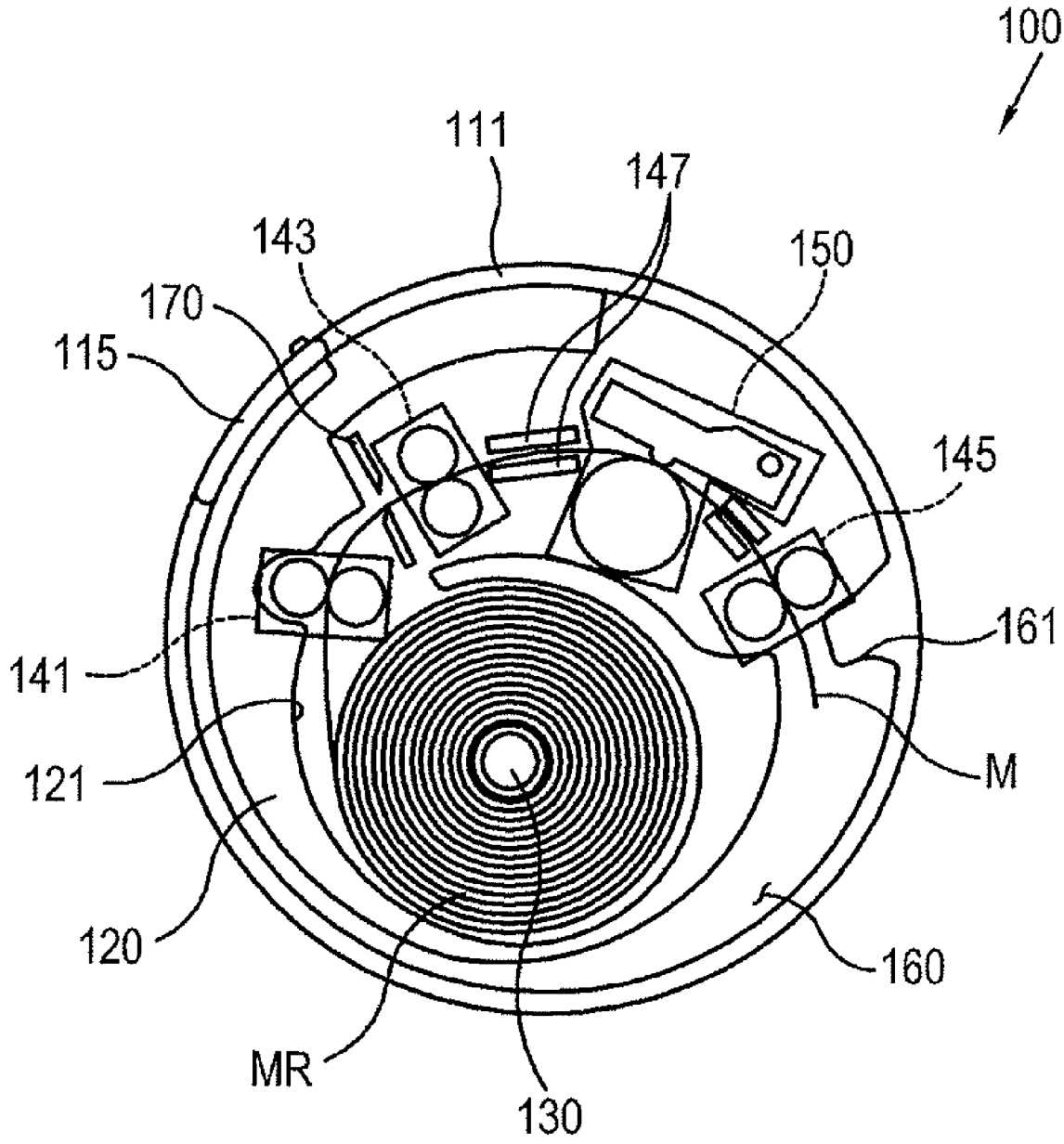

The leading edge portion a of the image formed printing medium M enters the printing medium receiving portion 160 via the discharge roller 145, as illustrated in FIG. 5B.

Figure 5C:
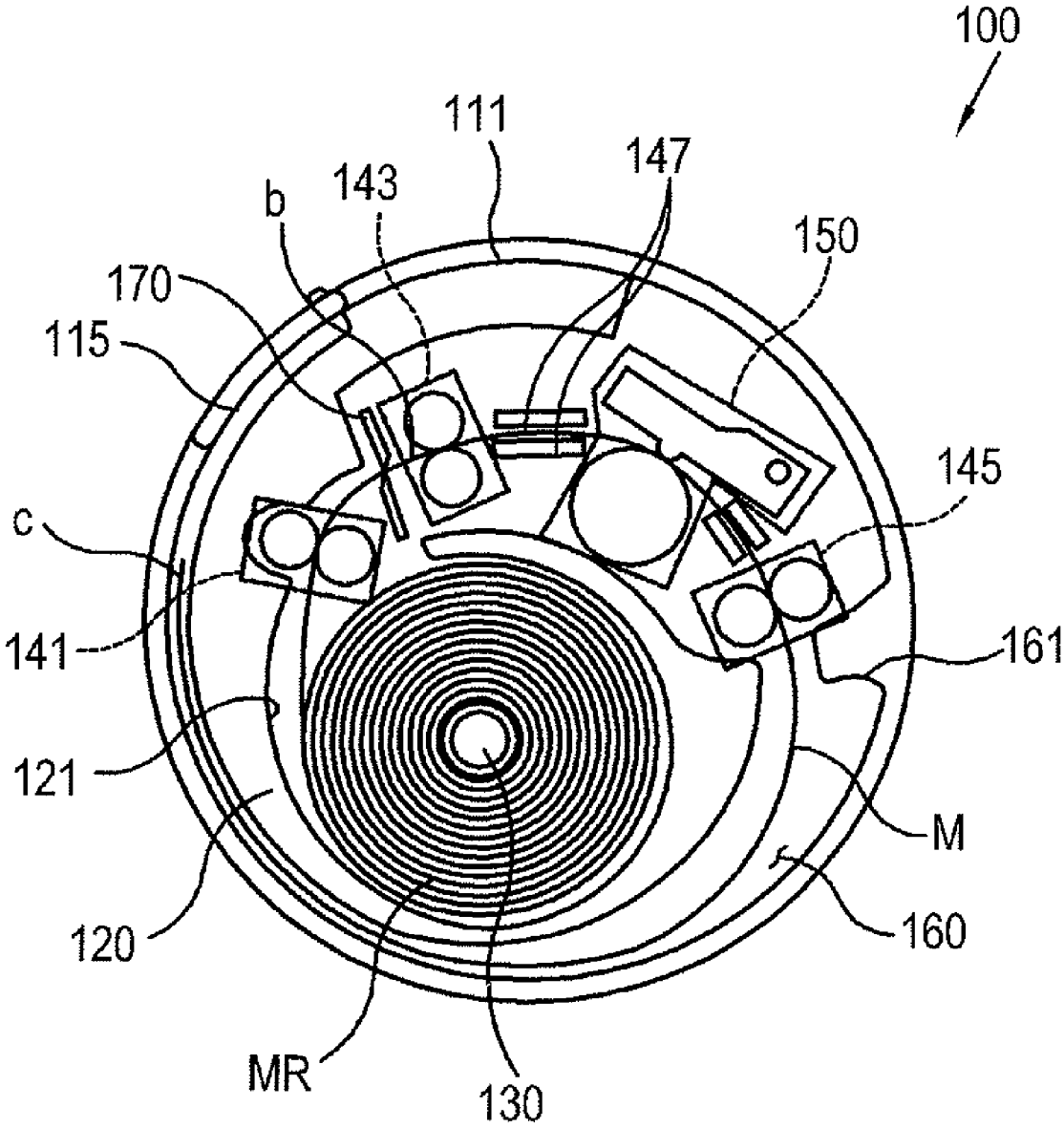

Then, as illustrated in FIG. 5C, if the length of the printing medium M supplied from the printing medium roll MR reaches a predetermined reference length, the cutting portion 170 cuts the printing medium M.

Figure 5D:
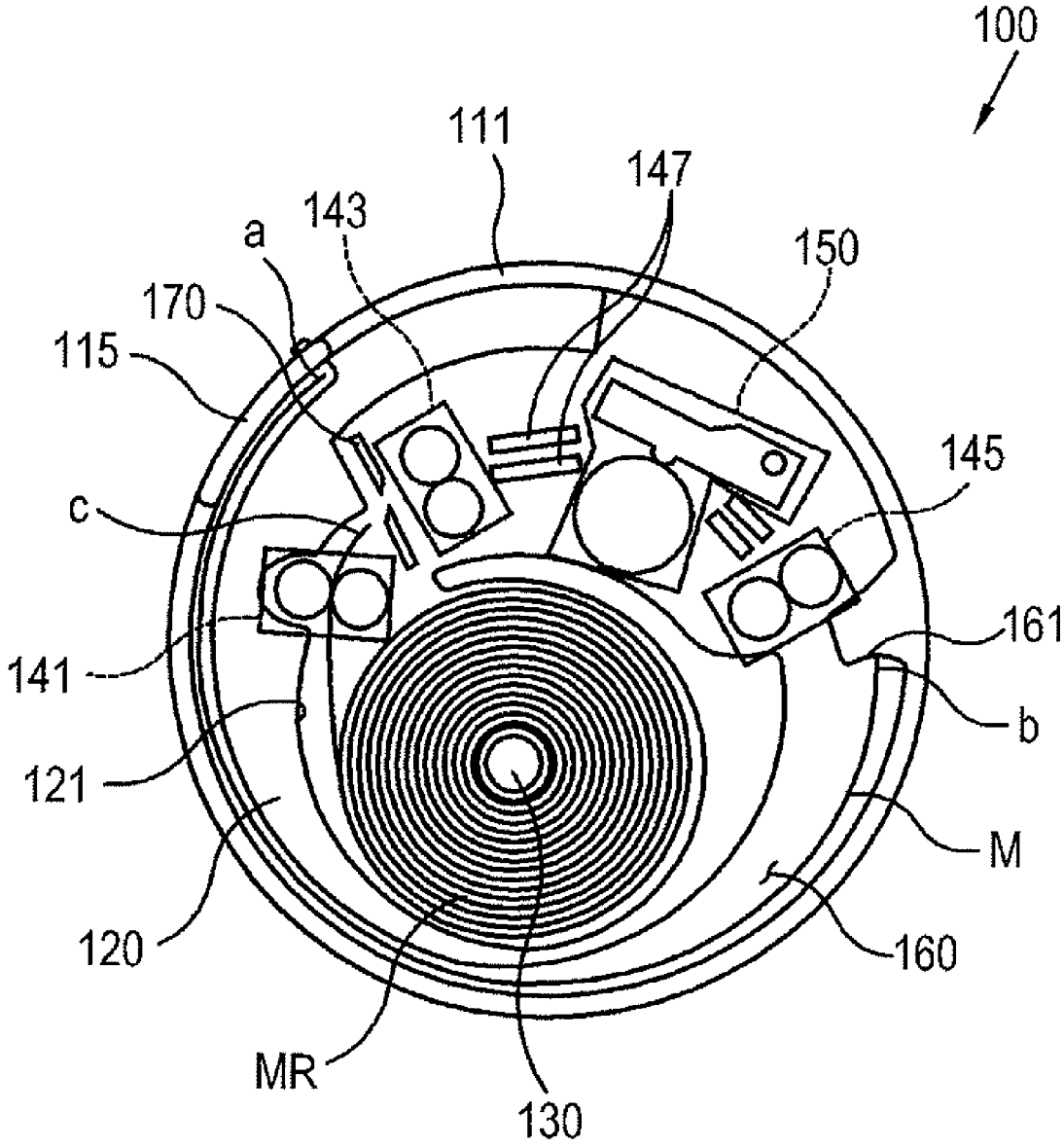

Then, as illustrated in FIG. 5D, the trailing edge portion b of the printing medium M enters the printing medium receiving portion 160, and accordingly, the entire printing medium M is positioned inside the printing medium receiving portion 160 with the trailing edge portion b being supported by the printing medium support rib 161. At this time, the leading edge portion a is positioned near the door 115.

Figure 5E:
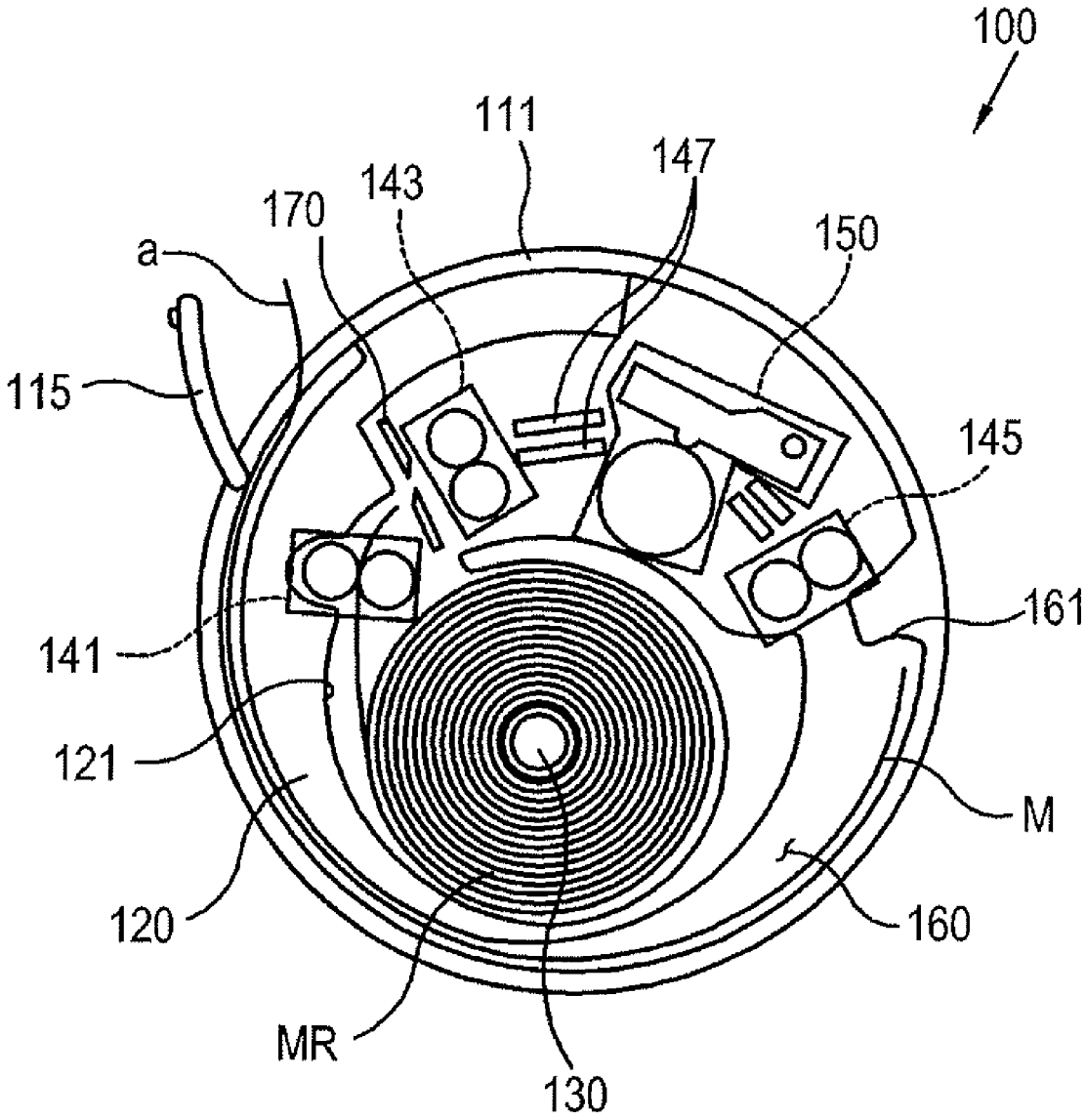

In this state, a user may open the door 115 to draw out the image formed printing medium M as illustrated in FIG. 5E, carry the image forming apparatus with the image formed printing medium remaining therein, or perform new printing.

If another printing signal is input to perform a new printing operation, the above process is repeated, and a new image formed printing medium may be stored in the printing medium receiving portion 160 together with the previously image formed printing medium.

Figure 1B:
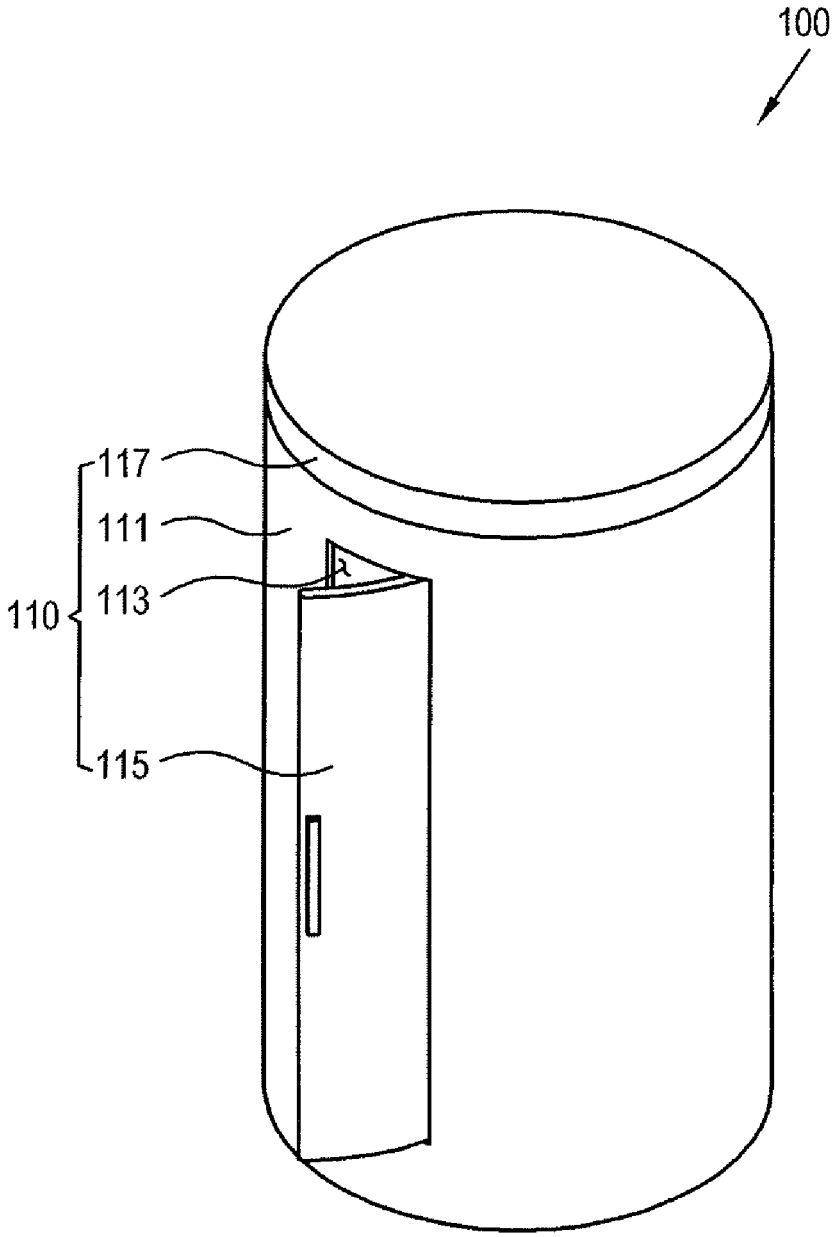
Figure 6:
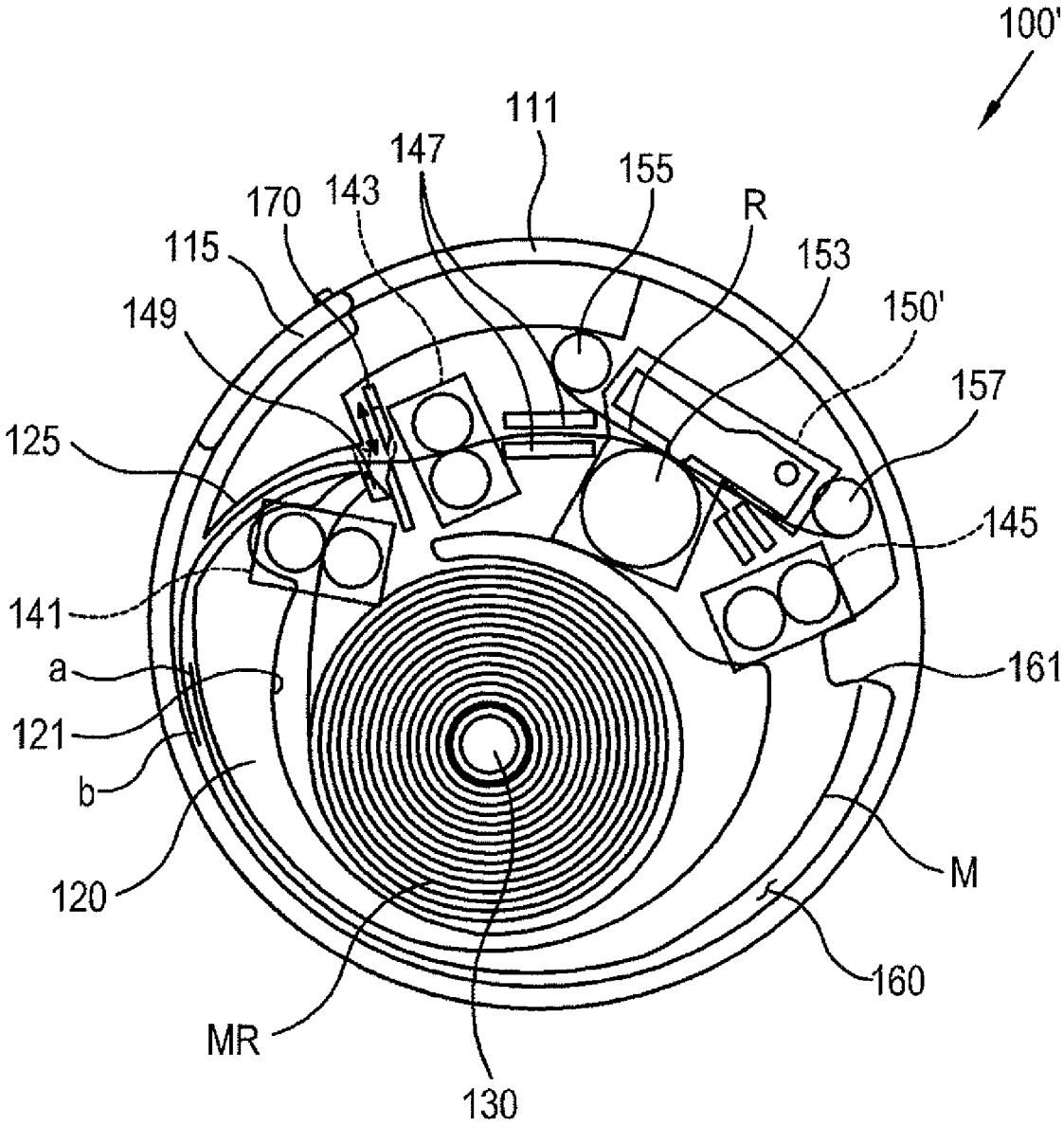
FIG. 6 illustrates a section of an image forming apparatus according to another exemplary embodiment of the present general inventive concept.

FIG. 6 illustrates a section of an image forming apparatus 100' according to another exemplary embodiment of the present general inventive concept. The same elements as those of the embodiment illustrated in FIGS. 1A and 1B are given the same reference numerals, and thus, a detailed description thereof may be omitted.

The image forming apparatus 100' according to the present embodiment includes an image forming unit 150' of a thermal transfer type. The image forming unit 150' presses an ink ribbon R against the printing medium M under heat to transfer ink coated on the ink ribbon R onto the printing medium M, thereby forming an image thereon. Here, the ink ribbon R is provided to have various colors, for example, yellow, magenta and cyan. Accordingly, the printing medium M reciprocally passes through the image forming unit 150' several times such as, for example, three times.

To this end, the image forming unit 150' may include a ribbon supplying core 155 to supply the ink ribbon R to the image forming unit 150' and a ribbon collecting core 157 to collect the used ink ribbon R.

In order to transfer the printing medium M reciprocally, the transfer roller 143 and the discharge roller 145 may rotate in a forward direction and a backward direction.

A backward transfer guide 125 is provided to the support frame 120 to guide the printing medium M which has been transferred in a backward direction. The backward transfer guide 125 may be extended from the printing medium receiving portion 160, as illustrated in FIG. 6, to minimize a space thereof.

A direction change lever 149 is rotatably provided between the pickup roller 141 and the transfer roller 143 to change a transfer direction of the printing medium M.

If the printing medium M is supplied from the printing medium roll MR, the direction change lever 149 rotates up, as illustrated in a dotted line, to allow the printing medium M to travel toward the transfer roller 143. Alternatively, if the printing medium M is cut by the cutting portion 170, the direction change lever 149 rotates down, as illustrated in a solid line, to guide the trailing edge portion of the printing medium M into the backward transfer guide 125.

Hereinafter, a process of forming an image in the image forming apparatus 100' according to present embodiment will be described.

Referring to FIG. 6, if the printing medium M is supplied to the image forming unit 150', the heat sensitive print head 151 applies heat and pressure to the ink ribbon R against the printing medium M to form a yellow image.

Then, the transfer roller 143 and the discharge roller 145 rotate backward to transfer the printing medium M backward. At this time, the direction change lever 149 rotates down to guide the trailing edge portion of the printing medium M into the backward transfer guide 125.

Next, the transfer roller 143 rotates forward to transfer the printing medium M toward the image forming unit 150' to form a magenta image. In this way, the above-described process is repeated.

After the image forming process is completed, the printing medium M is received in the printing medium receiving portion 160.

Figure 7:
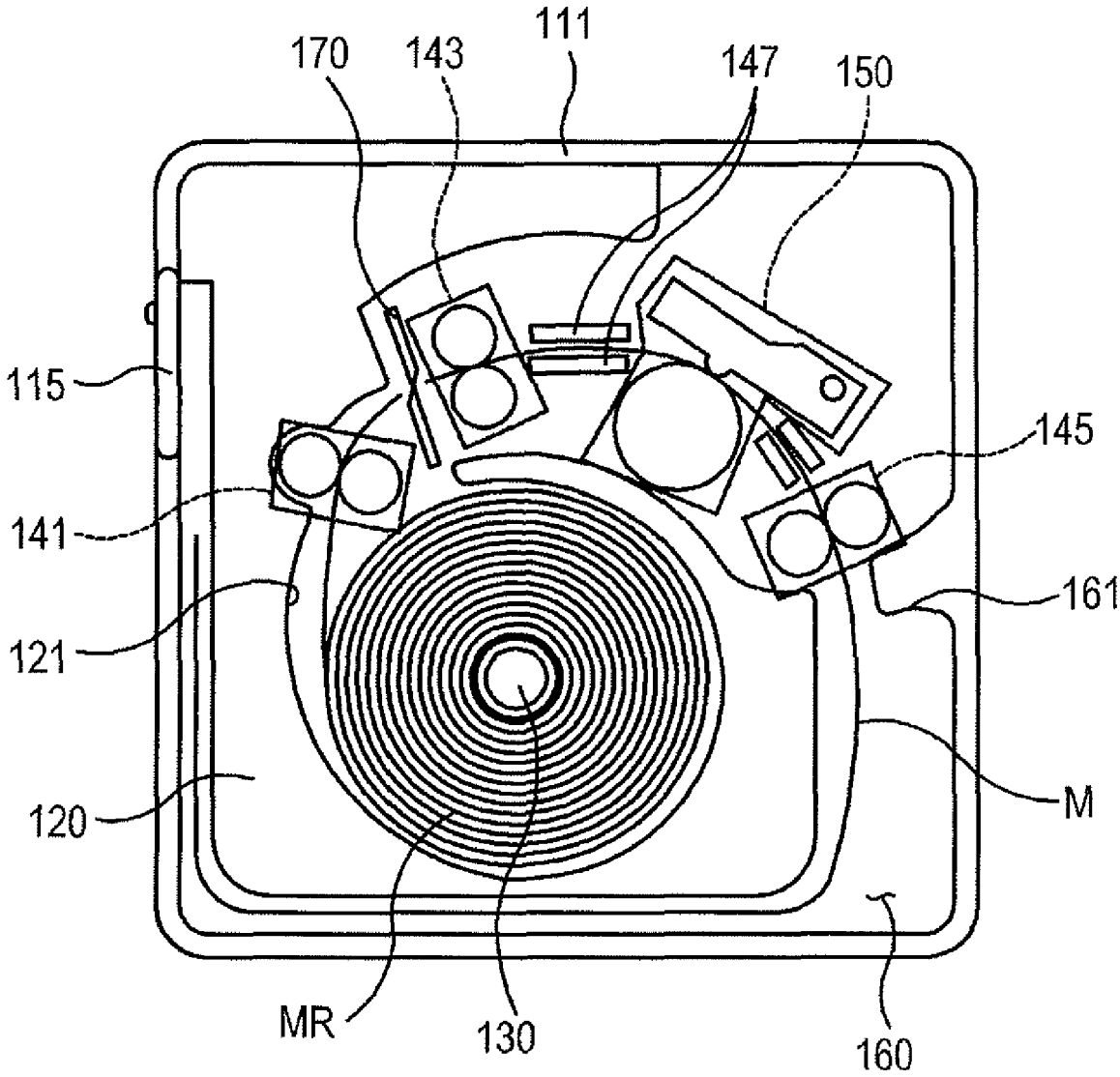
FIG. 7 illustrates a section of an image forming apparatus according to another exemplary embodiment of the present general inventive concept.

In the image forming apparatuses 100 and 100' according to various exemplary embodiments of the present general inventive concept, the casing 110 may have a cylindrical shape of a circular section. Alternatively, the casing 110 may have a cylindrical shape of a rectangular section, as illustrated in FIG. 7, or any other shape.

Figure 8:
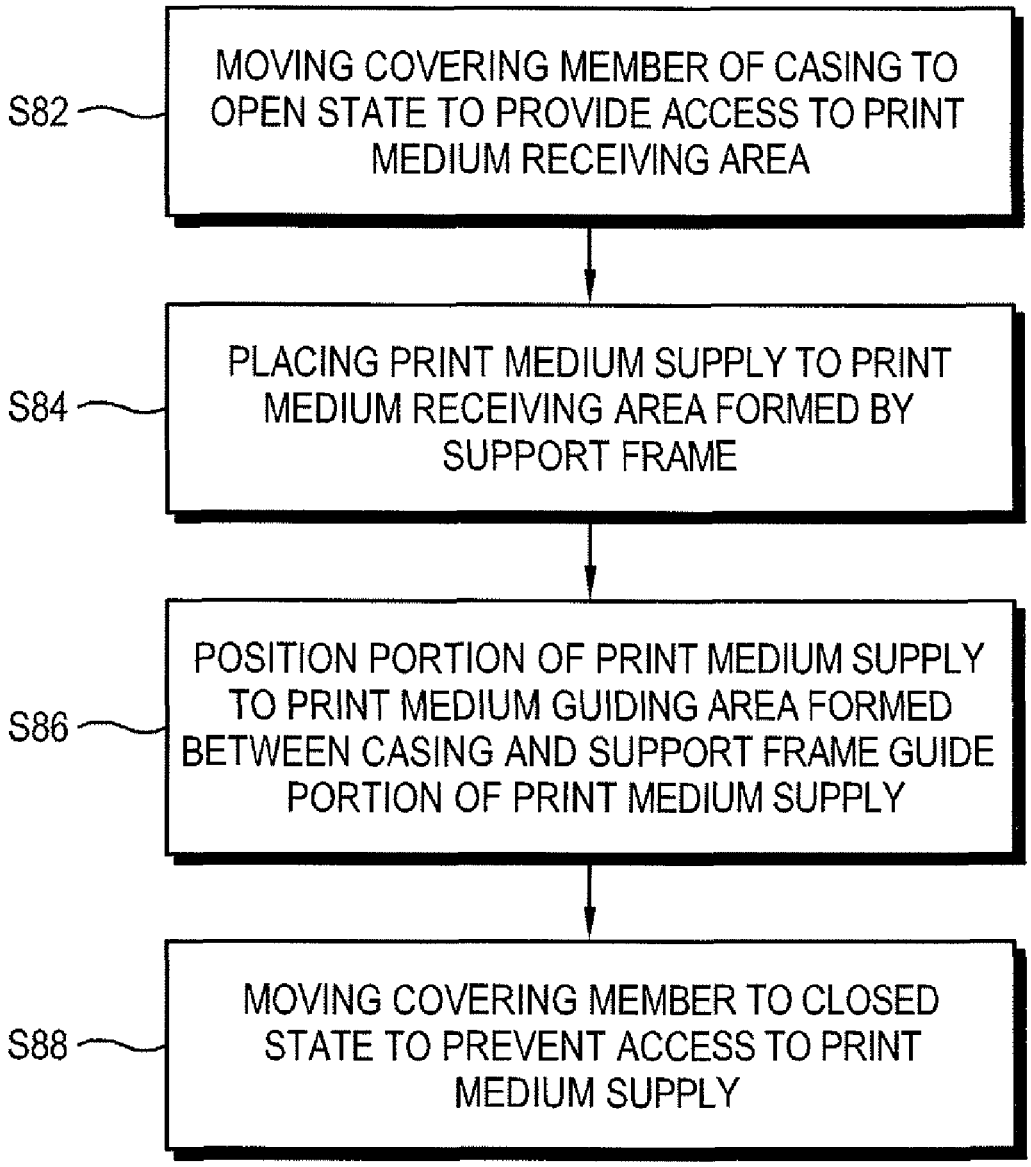
FIG. 8 is a flow chart illustrating a method of loading a print medium supply into an image forming apparatus according to an exemplary embodiment of the present general inventive concept.

FIG. 8 is a flow chart illustrating a method of loading a print medium supply into an image forming apparatus according to an exemplary embodiment of the present general inventive concept. Referring to FIG. 8, in operation S82, a covering member of a casing is moved to an open state to provide access to a print medium receiving area. In operation S84, the print medium supply is placed to the print medium receiving area formed by a support frame. In S86, a portion of the print medium supply is positioned to a print medium guiding area formed between the casing and the support frame to guide a portion of the print medium supply. In S88, the covering member is moved to a closed state to prevent access to the print medium supply. Accordingly, the image forming apparatus of the present embodiment can be moved to another location without the print medium supply being accessed and contaminated while in transit.

As described above, according to various embodiments of the present general inventive concept, there is provided an image forming apparatus to prevent a printing medium before image forming and an image formed printing medium from being exposed to the outside to thereby increase its portability.

Further, because the printing medium is supplied from inside the image forming apparatus, it is unnecessary for a user to manually supply each portion of the printing medium, and continuous printing is possible for a plurality of printing mediums.

Although various exemplary embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A mobile image forming apparatus, comprising:

a casing;

a support frame having a spiral cross sectional shape to surround a printing medium roll from which a printing medium printable in a plurality of colors is supplied and to guide the printing medium along a spiral path;

an image forming unit disposed along the spiral path to form an image having a plurality of colors on the printing medium guided by the support frame;

a cutting portion disposed along the spiral path and upstream of the image forming unit to cut the printing medium supplied from the printing medium roll into at least one sheet to be stored within the casing; and a printing medium receiving portion disposed between the casing and the support frame to receive therein the cut printing medium on which the image is formed by the image forming unit.

2. The mobile image forming apparatus according to claim 1, further comprising:

a roll support core disposed along a width of the printing medium roll in the support frame to rotatably support the printing medium roll.

3. The mobile image forming apparatus according to claim 2, wherein the roll support core is eccentrically disposed in a central area of the casing.

4. The mobile image forming apparatus according to claim 2, wherein the cutting portion is disposed along a printing medium path between the roll support core and the image forming unit to cut the printing medium supplied from the printing medium roll into a predetermined length.

5. The mobile image forming apparatus according to claim 1, wherein the casing is formed with a side opening through which at least a portion of the printing medium receiving portion is exposed outside.

6. The mobile image forming apparatus according to claim 5, further comprising:

a door coupled to the casing to open and close the side opening.

7. The mobile image forming apparatus according to claim 6, wherein the casing has a cylindrical shape of a circular section.

8. The mobile image forming apparatus according to claim 6, wherein the casing has a cylindrical shape of a polygonal section.

9. The mobile image forming apparatus according to claim 6, wherein the casing comprises:

a main casing to accommodate the image forming unit and the support frame; and a cover to open and close a top opening of the main casing.

10. The mobile image forming apparatus according to claim 1, wherein the printing medium receiving portion comprises:

a printing medium support rib to protrude from an inner surface of the casing and to support a trailing edge portion of the printing medium on which the image is formed.

11. The mobile image forming apparatus according to claim 10, wherein the printing medium receiving portion receives therein the plurality of printing mediums.

12. The mobile image forming apparatus according to claim 1, the image forming unit comprises:

a heat sensitive print head to heat the printing medium; and a platen to support the printing medium against the heat sensitive print head.

13. The mobile image forming apparatus according to claim 12, the image forming unit further comprises:

a ribbon supplying core disposed at a first side of the heat sensitive print head to supply an ink ribbon; and a ribbon collecting core disposed at a second side of the heat sensitive print head to collect the ink ribbon.

14. The mobile image forming apparatus according to claim 12, further comprising:

a transfer roller to transfer the printing medium to the image forming unit; and a discharge roller to discharge the printing medium on which the image is formed to the printing medium receiving portion.

15. The mobile image forming apparatus according to claim 14, wherein the transfer roller and the discharge roller are rotatable in a forward direction and a backward direction.

16. The mobile image forming apparatus according to claim 14, wherein the transfer roller, the discharge roller and the image forming unit are arranged in an arc shape around the roll support core.

17. The mobile image forming apparatus according to claim 15, wherein the support frame is formed with a backward transfer guide to guide the printing medium transferred in the backward direction by a backward rotation of the transfer roller and the discharge roller.

18. The mobile image forming apparatus according to claim 17, wherein the backward transfer guide is extended from the printing medium receiving portion.

19. The mobile image forming apparatus according to claim 17, further comprising:

a direction change lever disposed at a side of the transfer roller to guide the printing medium into the backward transfer guide when the printing medium is transferred in the backward direction.

20. An image forming apparatus including an image forming unit to form an image having a plurality of colors on a printing medium, the image forming apparatus comprising:

a casing having a rounded side portion comprising:

a flat cover adjacent the side portion to provide access to a print medium;

a side opening in the rounded side portion through which the printing medium is discharged;

a door to open and cover the side opening; and;

a first region having a spiral cross sectional shape inside the casing to store a print medium and supply the print medium to the image forming unit along a spiral path;

a cutting portion disposed along the spiral path and upstream of the image forming unit to cut the printing medium into at least one sheet to be stored within the casing; and a second region to receive the printing medium after passing through the image forming unit and the cutting portion.

21. The image forming apparatus of claim 20, wherein the second region is disposed between the casing and the first region.

22. The image forming apparatus of claim 21, wherein the image forming unit is disposed within the first region.

* * * * *